United States Patent [19]

Yoshitani et al.

[11] Patent Number: 4,893,858

[45] Date of Patent: Jan. 16, 1990

[54] MOVABLE YOKE-TYPE LIFTING MAGNET DEVICE

[75] Inventors: Naoyuki Yoshitani; Mitsunori Minamisawa; Tomomi Kishi, all of Toyota, Japan

[73] Assignee: Toyota Jidosha Kabushiki Kaisha, Aichi, Japan

[21] Appl. No.: 210,931

[22] Filed: Jun. 24, 1988

[30] Foreign Application Priority Data

Jun. 26, 1987 [JP] Japan ..... 62-97361[U]

[51] Int. Cl.[4] ..... B66C 1/06

[52] U.S. Cl. ..... 294/65.5; 335/291

[58] Field of Search ..... 294/65.5; 335/285, 286, 335/289, 291, 294, 298; 414/122, 737, 744 C

[56] References Cited

U.S. PATENT DOCUMENTS

| | | | |
|---|---|---|---|
| 777,221 | 12/1904 | Piek | 335/291 |
| 3,079,191 | 2/1963 | Engelsted et al. | 294/65.5 |
| 3,798,581 | 3/1974 | Anderson et al. | 335/291 |
| 3,968,986 | 7/1976 | Nagata | 294/65.5 |
| 4,652,845 | 3/1987 | Finkle | 294/65.5 X |

FOREIGN PATENT DOCUMENTS

| | | | |
|---|---|---|---|
| 1146993 | 5/1983 | Canada | 294/65.5 |
| 2321386 | 11/1974 | Fed. Rep. of Germany | 294/65.5 |
| 208579 | 4/1984 | German Democratic Rep. | 294/65.5 |
| 61-122279 | 8/1986 | Japan . | |
| 1444402 | 7/1976 | United Kingdom | 294/65.5 |

*Primary Examiner*—Johnny D. Cherry

*Attorney, Agent, or Firm*—Cushman, Darby & Cushman

[57] ABSTRACT

A movable yoke-type lifting magnet device including a core having first and second ends and at least one yoke provided so as to be movable relative to the core in a vertical direction at each of the first and second ends of the core. A movable framework and a drive member for driving the movable framework relative to the core are further provided for lifting and lowering each yoke relative to the core. When the movable framework is driven upwards, the movable framework engages with each yoke and forcibly lifts each yoke. When the movable framework is driven downwards, the movable framework releases the yokes to allow them to move downwards by their own weight and to be gently brought into contact with a workpiece to be lifted.

17 Claims, 4 Drawing Sheets

MOVABLE YOKE-TYPE LIFTING MAGNET DEVICE

BACKGROUND OF THE INVENTION

1. Field of the Invention

The present invention relates to a movable yoke-type lifting magnet device and, more particularly, relates to a device wherein a yoke movable relative to a core does not receive an upwardly and forcibly acting reaction force from a workpiece to be lifted.

2. Description of the Prior Art

Movable yoke-type lifting magnet devices are known as taught in Japanese Utility Model Publications SHO Nos. 61-122279 and 51-126570. The former publication discloses a yoke which is movable relative to a core assembly and which is forcibly driven downwards by a spring. The latter publication discloses a yoke which is movable relative to a core assembly and which is moved by means of weight of the yoke itself. Between the movable yoke and support members for slidably supporting the movable yoke, a clearance is provided for allowing the yoke to move. Accordingly, the movable yoke can tilt a little due to the clearance. In either device of both publications, a lower end of the movable yoke is constantly positioned lower than a lower surface of the core assembly. Therefore, when the device approaches a workpiece to be lifted from an upper side of the workpiece, at first the yoke is brought into contact with the workpiece, and then the yoke is forcibly moved upwards relative to the core assembly, receiving an upwardly acting reaction force from the workpiece.

However, when the upper surface of the workpiece is inclined from a horizontal plane, the direction of the reaction force acting on the yoke from the workpiece is inclined from an exactly vertical direction and the yoke is liable to tilt. As a result, the frictional force caused between the yoke and the support members therefor becomes large. This deteriorates smooth movement of the yoke relative to the core via the support members, injures and deforms the workpiece to be lifted, causes a severe abrasion of the sliding surfaces of the lifting magnet device, and causes unstable magnetic coupling between the yoke and the workpiece. Such troubles often take place when the yoke is moved upwards relative to the core by a large distance and at high speeds.

SUMMARY OF THE INVENTION

An object of the present invention is to provide a movable yoke-type lifting magnet device wherein the yoke does not receive an upwardly and forceably acting reaction force from a workpiece to be lifted when the device is carried to a position above and in the vicinity of the workpiece and the yoke is brought into contact with the workpiece.

According to the present invention, the above-mentioned object can be achieved by a movable yoke-type lifting magnet device comprising (a) a core having first and second ends, (b) at least one yoke provided at each of the first and second ends of the core, respectively, each yoke having a lower end adapted to magnetically couple with a workpiece to be lifted, each yoke being slidable relative to the core in a vertical direction when the core is not magnetically excited and being magnetically coupled to the core when the core is magnetically excited, (c) a movable framework supported so as to be movable relative to the core in the vertical direction, the movable framework engaging with each yoke to lift each yoke when the movable framework is moved upwards, the movable framework releasing each yoke so as to allow each yoke to move downwards by means of weight of each yoke itself when the movable framework is moved downwards; and (d) a drive member, mounted to connect the core and the movable framework, for lifting and lowering the movable framework relative to the core in the vertical direction.

When the device is carried to a position above and in the vicinity of the workpiece to be lifted, the movable framework is held at its upper position by the drive member to thereby hold each yoke to an upper end position of the stroke of each yoke. When the device has been carried to the position above and in the vicinity of the workpiece, the drive member drives the movable framework downwards. When the movable framework is moved downwards, each yoke moves downwards by means of its own weight and at last is brought into contact with the upper surface of the workpiece to be lifted to stop. In the downward movement, each yoke is not affected by any reaction force from the workpiece, by any shape of the contour of the workpiece, by any amount of stroke of each yoke, and by any speed of movement of each yoke. When the lower end of each yoke has been brought into contact with the workpiece, the core is magnetically excited to thereby magnetically couple with each yoke and to make each yoke magnetically couple with the workpiece to be lifted. Then, the device with the workpiece is lifted and carried.

BRIEF DESCRIPTION OF THE DRAWINGS

The above and other objects, features and advantages of the present invention will become more apparent and will be more readily appreciated from the following detailed description of the preferred exemplary embodiments of the invention in conjunction with the accompanying drawings, in which.

DETAILED DESCRIPTION OF THE PREFERRED EMBODIMENTS

Figure 1:
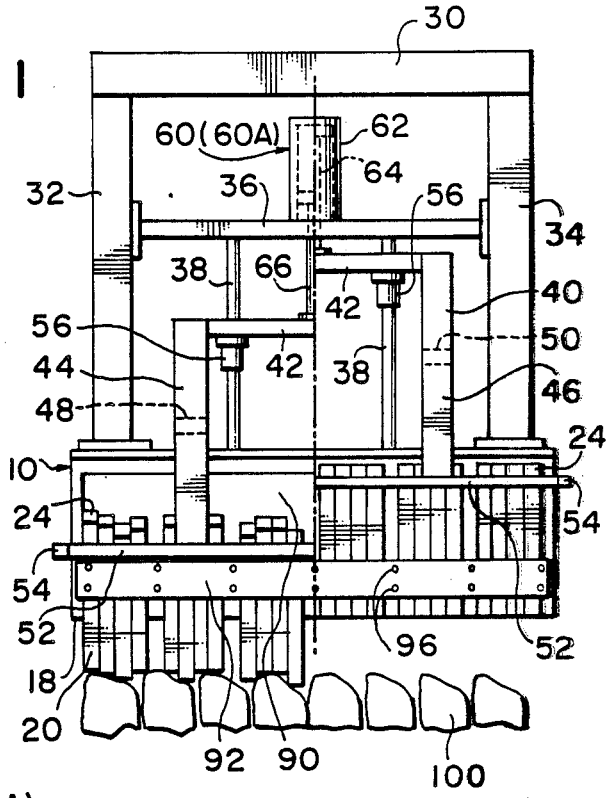
FIG. 1 is a front elevational view of a movable yoke-type lifting magnet device in accordance with a first embodiment of the present invention, a left half portion of FIG. 1 illustrating a state where a yoke is lowered and a right half portion of FIG. 1 illustrating a state where the yoke is lifted.

First, the structure common with respect to every embodiment will be explained, referring to FIGS. 1–4.

A movable yoke-type lifting magnet device comprises a core 12 having a first end 12*a* and a second end 12*b* opposite first end 12*a*, at least one yoke 20 provided at each of first and second ends 12*a* and 12*b* of core 12, respectively, a movable framework 40 supported so as to be movable relative to core 12 in a vertical direction, and a drive member 60A, mounted to connect core 12 and movable framework 40, for driving movable framework 40 relative to core 12. Each yoke 20 has a lower end 22 adapted to magnetically couple with a workpiece 100 to be lifted. Each yoke 20 is slidable relative to core 12 in the vertical direction when core 12 is not magnetically excite and is magnetically coupled to core 12 when core 12 is magnetically excited. Movable framework 40 engages with each yoke 20 to lift each yoke 20 when movable framework 40 is moved upwards. Movable framework 40 releases each yoke 20 so as to allow each yoke 20 to move downwards by means of its own weight when movable framework 40 is moved downwards. Drive member 60A lifts and lowers movable framework 40 relative to core 12 in the vertical direction.

More particularly, the movable yoke-type lifting magnet device comprises a core assembly 10 including core 12 which has first end 12*a* and second end 12*b* opposite first end 12*a*, at least one yoke 20 provided at each of first and second ends 12*a* and 12*b* of core 12, respectively, a fixed framework 30 fixedly coupled to core assembly 10, movable framework 40 supported so as to be movable relative to core 12 in the vertical direction, and drive member 60A for driving movable framework 40 relative to core 12 in the vertical direction. Core assembly 10 has a lower surface 18 and also includes core 12 constructed of magnetic material, a coil 14 wound around core 12, and a casing 16 for supporting core 12. Coil 14 is electrically connected to a direct current power source (not shown) in a manner well known in the art. First and second ends 12*a* and 12*b* of core 12 are coupled to casing 16. Core 12 may comprise a plurality of core pieces 12-1, 12-2, 12-3 . . . which are arranged in parallel with each other. Each yoke 20 is constructed of magnetic material. Each yoke 20 extends in the vertical direction and has lower end 22 adapted to magnetically couple with workpiece 100 to be lifted, and an upper end. As mentioned heretofore, each yoke 20 is slidable relative to core 12 in the vertical direction when core 12 is not magnetically excited and is magnetically coupled to core 12 when core 12 is magnetically excited. Each yoke 20 has a first engagement member 24. Movable framework 40 has a second engagement member 52 provided on each side of core assembly 10, respectively. Each second engagement member 52 is arranged so as to be engageable with first engagement member 24. More particularly, when movable framework 40 is moved upwards, second engagement member 52 engages with each first engagement member 24 to lift each yoke 20 and when movable framework 40 is moved downwards, second engagement member 52 releases each yoke 20 and allows each yoke 20 to move downwards by its own weight. Drive member 60A lifts and lowers movable framework 40 relative to fixed framework 30 fixed to core assembly 10 in the vertical direction between an upper end position P1 and a lower end position P2 of the stroke of movable framework 40 relative to fixed framework 30.

Upper end position P1 of the stroke of movable framework 40 relative to fixed framework 30 is determined such that when movable framework 40 is positioned at upper end position P1, the lower end 22 of each yoke 20 is preferably positioned not lower than the lower surface 18 of core assembly 10. Lower end position P2 of the stroke of movable framework 40 relative to fixed framework 30 is determined such that when movable framework 40 is positioned at lower end position P2, lower end 22 of each yoke 20 is positioned lower than lower surface 18 of core assembly 10 by a distance H1 greater than a vertical distance H2 between highest and lowest points of an upper surface of work 100 to be lifted. The stroke of movable framework 40 should be larger than vertical distance H2.

First engagement member 24 of each yoke 20 preferably comprises a protrusion 24' formed at the upper end of each yoke 20 and protruding in a direction opposite to core 12. Second engagement member 52 of movable framework 40 comprises an engagement bar 52' extending in a horizontal direction on a lower side of protrusion 24' so that engagement bar 52' is engageable with protrusion 24' when movable framework 40 is moved upwards relative to fixed framework 30. The above-mentioned first and second engagement members 24 and 52 may be substituted by a first engagement member comprising a vertically extending groove formed in each yoke 20 and a second engagement member comprising a plurality of pins fixed to movable framework 40 so as to be engageable with the vertically extending groove. The above-mentioned first and second engagement members 24 and 52 may be further substituted by a flexible string having first and second ends, the first end of the string being connected to each yoke 20 and the second end of the string being connected to movable framework 40.

The movable yoke-type lifting magnet device further comprises a first slide plate 90 constructed of magnetic material and fixed to each of first and second ends 12*a* and 12*b* of core 12, respectively, and a second slide plate 92 constructed of non-magnetic material and fixed to each first slide plate 90, respectively, by a pin 96 via a distance piece 94. Each first slide plate 90 and each second slide plate 92 are distanced from each other by a thickness of distance piece 94 in the horizontal direction to define a clearance therebetween in the horizontal direction. Each yoke 20 passes through the clearance so as to be movable relative to core 12 in the vertical direction.

Fixed framework 30 comprises an inverted U-shaped framework, an axis of which extends in a plane perpendicular to a plane including centers of first and second ends 12*a* and 12*b* of core 12. The inverted U-shaped framework has legs 32 and 34 extending in the vertical direction and the U-shaped framework is fixed to casing 16 of core assembly 10 at lower ends of legs 32 and 34. Fixed framework 30 further comprises a support bar 36 extending between legs 32 and 34 of the inverted U-shaped framework, and drive member 60A is supported on support bar 36. Fixed framework 30 further comprises a guide rod 38 extending in the vertical direction between support bar 36 and core assembly 10.

Movable framework 40 comprises a first arm 42 horizontally extending and having a first end and a second end opposite the first end, two second arms 44 and 44 extending downwards from the first end of first arm 42 and two third arms 46 and 46 extending downwards from the second end of first arm 42. Engagement bar 52' of second engagement member 52 is provided on each side of core assembly 10, and extends between a lower end of each of second arms 44 and 44 and a lower end of each of third arms 46 and 46, respectively.

Movable framework 40 further comprises a first reinforcement bar 48 and a second reinforcement bar 50. First reinforcement bar 48 extends between two second arms 44 and 44 at longitudinally intermediate portions of two second arms 44 and 44 and second reinforcement bar 50 extends between two third arms 46 and 46 at longitudinally intermediate portions of two third arms 46 and 46. Movable framework 40 furthermore comprises a third reinforcement bar 54. Third reinforcement bar 54 extends between and connects an end of one engagement bar 52' provided on one side of core assembly 10 and an end of another engagement bar 52' provided on another side of core assembly 10. Movable framework 40 further comprises a guide bushing 56 fixed to first arm 42 and slidably coupled with guide rod 38 of first framework 30.

Each yoke 20 is gradually narrowed toward lower end 22 of each yoke 20 at a lower end portion 26 of each yoke 20.

Figure 4:
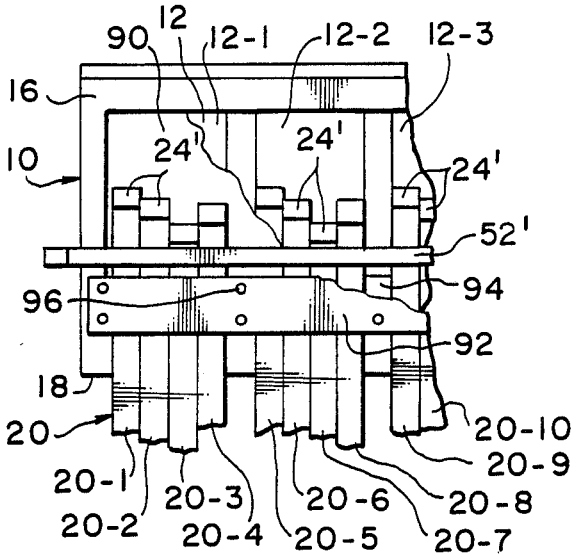
FIG. 4 is a front elevational view of the core and the members of FIG. 3.

A plurality of yokes 20 are provided at each end of core 12, respectively, as shown in FIG. 4 by members denoted with reference numerals 20-1, 20-2, 20-3 . . . . One yoke, for example, a yoke 20-2, is slidable in the vertical direction relative to adjacent yokes, a yoke 20-1 and a yoke 20-3.

Workpiece 100 to be lifted may comprise a plurality of workpieces and may have an upper surface inclined from a horizontal plane. The stroke of movement of each yoke 20 and distance H1 between lower end 22 of each yoke 20 positioned at its lower stroke end and lower surface 18 of yoke assembly 10 are greater than vertical distance H2 between highest and lowest points of the inclined upper surface of workpiece 100 to be lifted.

Next, structures which are different from each other among the embodiments will be explained. The embodiments differ from each other in structure of drive member 60A, 60B and 60C.

Figure 2:
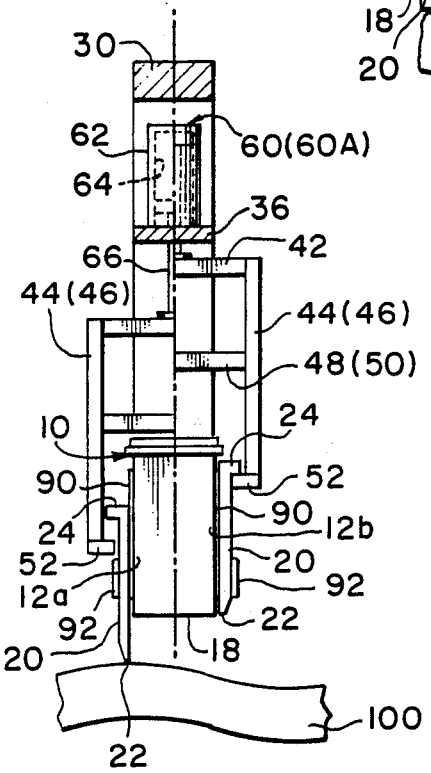
FIG. 2 is a side elevational view of the device of FIG. 1, a left half portion of FIG. 2 illustrating a state where the yoke is lowered and a right half portion of FIG. 2 illustrating a state where the yoke is lifted.
Figure 3:
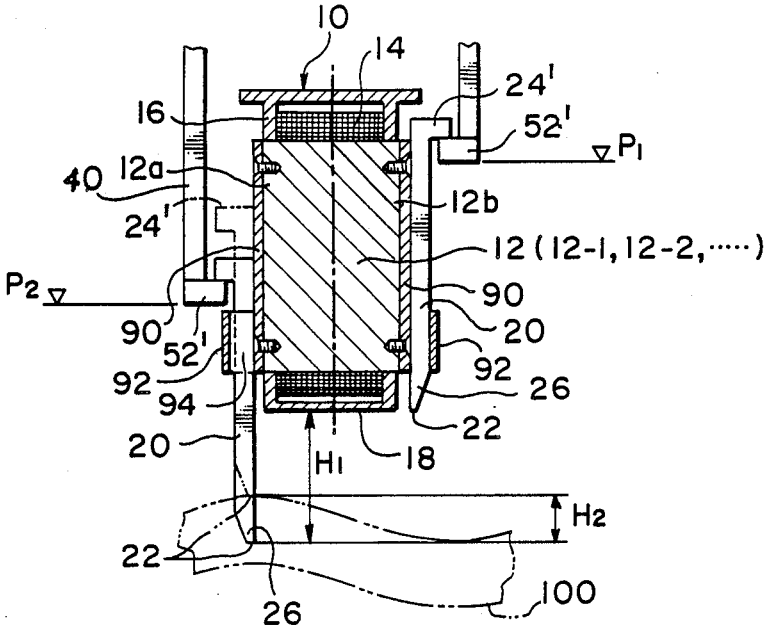
FIG. 3 is a sectional view of a core and members positioned in the vicinity of the core of the device of FIG. 1, a left half portion of FIG. 3 illustrating a state where the yoke is lowered and a right half portion of FIG. 3 illustrating a state where the yoke is lifted.

As shown in FIGS. 1 and 2, drive member 60A of the first embodiment comprises an air cylinder 62 having a cylinder portion 64 and a rod 66 extending in the vertical direction and which can reciprocate with respect to cylinder portion 64. Cylinder portion 64 is coupled to one of fixed framework 30 and movable framework 40, and rod 66 is coupled to the other of fixed framework 30 and movable framework 40.

Figure 5:
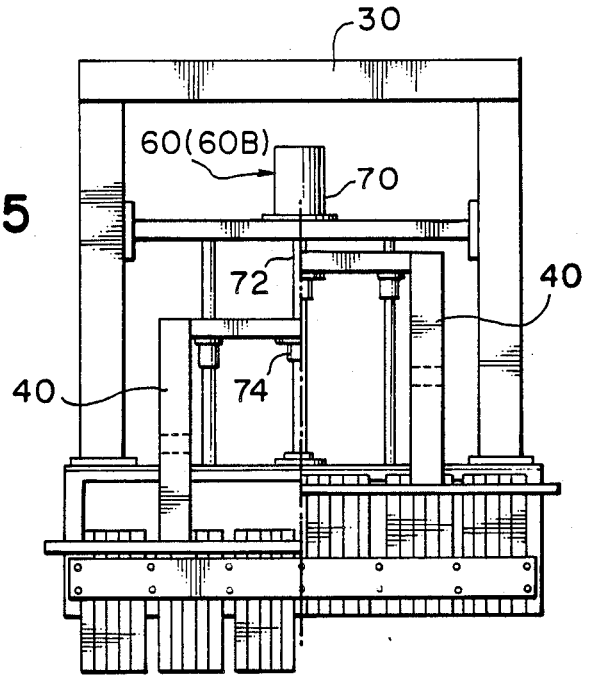
FIG. 5 is a front elevational view of a movable yoke-type lifting magnet device in accordance with a second embodiment of the present invention, a left half portion of FIG. 5 illustrating a state where a yoke is lowered and a right half portion of FIG. 5 illustrating a state where the yoke is lifted.
Figure 6:
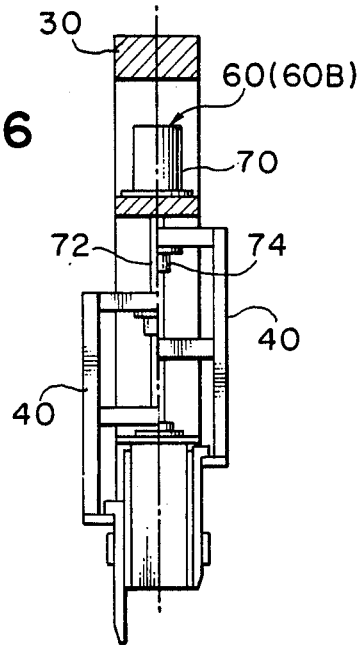
FIG. 6 is a side elevational view of the device of FIG. 5, a left half portion of FIG. 6 illustrating a state where the yoke is lowered and a right half portion of FIG. 6 illustrating a state where the yoke is lifted.

As shown in FIGS. 5 and 6, drive member 60B of the second embodiment comprises a reversible electric motor 70 supported by fixed framework 30 and a screw coupling 74 supported by movable framework 40. An output shaft of motor 70 is connected to a rotational shaft 72 extending in the vertical direction between fixed framework 30 and core assembly 10. Screw coupling 74 is rotatably coupled to rotational shaft 72 such that reversible rotation of rotational shaft 72 lifts and lowers movable framework 40 via screw coupling 74.

Figure 7:
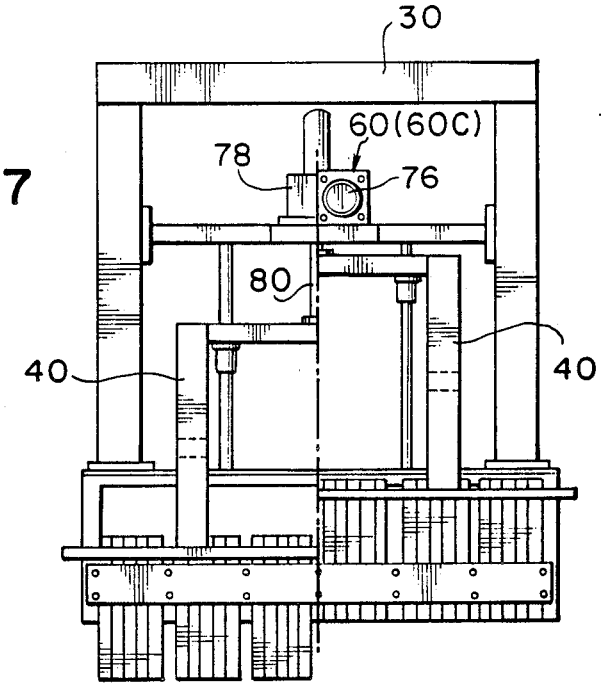
FIG. 7 is a front elevational view of a movable yoke-type lifting magnet device in accordance with a third embodiment of the present invention, a left half portion of FIG. 7 illustrating a state where a yoke is lowered and a right half portion of FIG. 7 illustrating a state where the yoke is lifted.
Figure 8:
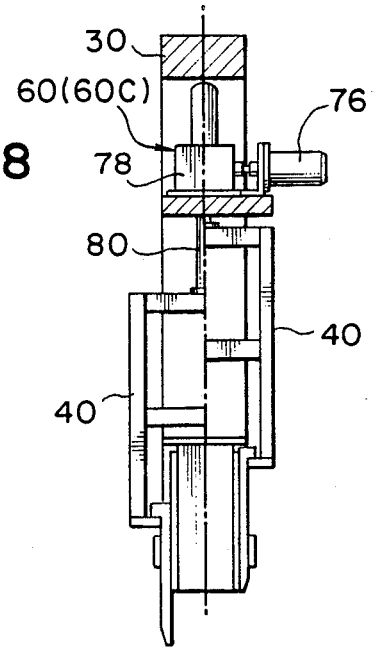
FIG. 8 is a side elevational view of the device of FIG. 7, a left half portion of FIG. 8 illustrating a state where the yoke is lowered and a right half portion of FIG. 8 illustrating a state where the yoke is lifted.

As shown in FIGS. 7 and 8, drive member 60C of the third embodiment comprises a reversible electric motor 76 supported by fixed framework 30 and a screw jack 78 supported by fixed framework 30. Electric motor 76 has a rotational output shaft extending in the horizontal direction. Screw jack 78 has a first shaft coupled to the output shaft of electric motor 76 and a second shaft 80 extending in the vertical direction and driven in the vertical direction. Second shaft 80 is coupled to movable framework 40 so as to lift and lower movable framework 40.

Next, operation of the movable yoke-type lifting magnet device according to the present invention will be explained.

When the device approaches workpiece 100 to be lifted, movable framework 40 is held at its upper position P1 by drive member 60A, 60B, 60C and therefore each yoke 20 is lifted to the upper stroke end of each yoke 20. When the device has been carried to a position above and in the vicinity of workpiece 100 to be lifted, drive member 60A, 60B, 60C drives movable framework 40 downwards. As a result, each yoke 20 moves downwards by means of the weight of each yoke 20 itself by an amount corresponding to the downward movement of movable framework 40 and is brought into contact with the upper surface of workpiece 100 to be lifted, at which position it stops. The downward movement of each yoke 20 is not affected by any force from workpiece 100 to be lifted nor by any shape or contour of workpiece 100 to be lifted, no matter how large the stroke of each yoke 20 is and no matter how high the speed of each yoke 20 is. When lower end 22 of each yoke 20 has been brought into contact with workpiece 100 to be lifted, core 12 is magnetically excited to thereby magnetically couple with each yoke 20 at each first and second ends **12*a* and 12*b* of core 12 via each first slide plate 90 of magnetic material, to produce a magnetic flux path passing through core 12, yoke 20 positioned on one end of core 12, workpiece 100 to be lifted, yoke 20 positioned on another end of core 12, and core 12, and to cause each yoke 20 to magnetically couple with workpiece 100 to be lifted. Then, the device is lifted by fixed framework 30 and is carried with workpiece 100 to a necessary place where the magnetic excitation of core 12 is turned off to release workpiece 100** from the device.

According to the present invention, the following effects are obtained.

Because each yoke 20 moves toward workpiece 100 to be lifted from the position above workpiece 100 to be lifted by means of the weight of each yoke 20 itself, each yoke 20 does not receive an upwardly or obliquely acting and forceably acting reaction force from workpiece 100 to be lifted. As a result, the movement of each yoke 20 relative to core 12 and first and second slide plates 90 and 92 is very smooth and is not accompanied by a momentary sticking between each yoke 20 and first and second slide plates 90 and 92. Accordingly, deformation of workpiece 100 to be lifted due to an excessive force from yoke 20 and severe abrasion of the sliding surfaces of the device due to an excessive frictional force will not be caused. Further, due to the downward movement of each yoke 20 by means of the weight of each yoke 20, the device can be applied to lifting and carrying any workpiece without paying any care to the contour of the workpiece. Furthermore, due to the downward movement of each yoke 20 by means of the weight of yoke 20, without being accompanied by a tilting of yoke 20 or large frictional forces between yoke 20 and first and second slide plates 90 and 92, lowering of each yoke 20 with high speed is possible, which can increase the operation speed of the device. When the lower end 22 of each yoke 20 is relatively lifted higher than the lower surface 18 of core assembly 10 during an approach of the device to the workpiece to be lifted, there is no fear of any interference between each yoke 20 and workpiece 100 to be lifted when carrying the device to the workpiece 100 to be lifted, which makes handling of the device easy.

Although only several embodiments of the present invention have been described in detail, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A movable yoke-type lifting magnetic device comprising:

a magnetic core having first and second ends and adapted to be selectively magnetically excited;

at least one yoke provided at each of said first and second ends of said core, respectively, each said yoke having a lower end adapted to magnetically couple with a workpiece to be lifted, and each said yoke being configured to be slidable relative to said core in a vertical direction when said core is not magnetically excited and to be magnetically coupled to said core when said core is magnetically excited;

a movable framework supported so as to be movable relative to said core in the vertical direction, said movable framework including means for engaging with each said yoke to lift each said yoke when said movable framework is moved upwards, and for releasing each said yoke so as to allow each said yoke to move downwards by its own weight when said movable framework is moved downwards; and drive means, mounted to connect said core and said movable framework, for lifting and lowering said movable framework in the vertical direction relative to said core.

2. A movable yoke-type lifting magnet device comprising:

a magnetic core assembly having a lower surface and including a magnetic core having first and second ends and adapted to be selectively magnetically excited, a coil wound around said core, and a casing coupled to portions of said core adjacent to said first and second ends of said core;

at least one yoke constructed of magnetic material and provided at each of said first and second ends of said core, respectively, each said yoke extending in a vertical direction and having a lower end adapted to magnetically couple with a workpiece to be lifted and an upper end, each said yoke being configured to be slidable relative to said core in the vertical direction when said core is not magnetically excited and to be magnetically coupled to said core when said core is magnetically excited, each said yoke having a first engagement member coupled thereto;

a fixed framework fixedly coupled to said core assembly;

a movable framework supported so as to be movable relative to said fixed framework in the vertical direction, said movable framework having a second engagement member provided on each side of said core assembly, respectively, and arranged so as to be engageable with said first engagement member of each said yoke such that when said movable framework is moved upwards, said second engagement member engages with said first engagement member of each said yoke to lift each said yoke by a distance and when said movable framework is moved downwards, said second engagement member releases each said yoke to allow each said yoke to move downwards by its own weight; and drive means, mounted to connect said fixed framework and said movable framework, for lifting and lowering said movable framework relative to said fixed framework in the vertical direction between an upper end position and a lower end position of a stroke of said movable framework relative to said fixed framework.

3. The device according to claim 2, wherein said upper end position of said stroke of said movable framework relative to said fixed framework is determined such that when said movable framework is positioned at said upper end position, said lower end of each said yoke is positioned not lower than said lower surface of said core assembly.

4. The device according to claim 2, wherein said lower end position of said stroke of said movable framework relative to said fixed framework is determined such that when said movable framework is positioned at said lower end position, said lower end of each said yoke is positioned lower than said lower surface of said core assembly by a distance greater than a vertical distance between highest and lowest points of an upper surface of the workpiece to be lifted.

5. The device according to claim 2, wherein said first engagement member of each said yoke comprises a protrusion formed at said upper end of each said yoke and protruding in a direction opposite to said core, and wherein said second engagement member of said movable framework comprises an engagement bar extending in a horizontal direction on a lower side of said protrusion so that said engagement bar engages with said protrusion when said movable framework is moved upwards relative to said fixed framework and said engagement bar releases said protrusion when said movable framework is moved downwards.

6. The device according to claim 5, wherein said movable framework comprises a first horizontally extending arm having first and second ends, two second arms extending downwards from said first end of said first arm and two third arms extending downwards from said second end of said first arm, said engagement bar of said second engagement member provided on each side of said core assembly extending between a lower end of each of said second arms and a lower end of each of said third arms, respectively.

7. The device according to claim 6, wherein said movable framework further comprises a first reinforcement bar and a second reinforcement bar, said first reinforcement bar extending between said two second arms at longitudinally intermediate portions of said two second arms and said second reinforcement bar extending between said two third arms at longitudinally intermediate portions of said two third arms.

8. The device according to claim 7, wherein said movable framework further comprises a third reinforcement bar, said third reinforcement bar extending between and connecting an end of one said engagement bar provided on one side of said core assembly and an end of another said engagement bar provided on another side of said core assembly.

9. The device according to claim 2, further comprising a first slide plate fixed to each of said first and second ends of said core, respectively, and a second slide plate fixed to each said first slide plate, respectively, via a distance piece, each said first slide plate and each said second slide plate being spaced from each other in a horizontal direction to define a clearance therebetween in the horizontal direction, each said yoke passing through said clearance so as to be movable relative to said core in the vertical direction.

10. The device according to claim 2, wherein said fixed framework comprises an inverted U-shaped framework, an axis of which extends in a plane perpendicular to a plane including centers of said first and second ends of said core, said inverted U-shaped framework having legs extending in the vertical direction, said U-shaped framework being fixed to said casing of said core assembly at lower ends of said legs.

11. The device according to claim 10, wherein said fixed framework further comprises a support bar extending between said legs of said inverted U-shaped framework, said drive means being supported on said support bar.

12. The device according to claim 2, wherein said fixed framework includes a guide rod extending in the vertical direction and said movable framework includes a guide bushing slidably coupled with said guide rod of said fixed framework.

13. The device according to claim 2, wherein each said yoke is gradually narrowed toward said lower end of each said yoke at a lower end portion of each said yoke.

14. The device according to claim 2, wherein a plurality of said yokes are provided at each end of said core, respectively, such that one of said yokes is slidable relative to an adjacent one of said yokes in the vertical direction.

15. The device according to claim 2, wherein said drive means comprises an air cylinder having a cylinder portion and a rod extending in the vertical direction and reciprocating with respect to said cylinder portion, said cylinder portion being coupled to one of said fixed framework and said movable framework and said rod being coupled to the other of said fixed framework and said movable framework.

16. The device according to claim 2, wherein said drive means comprises:

a reversible electric motor supported by said fixed framework;

a rotational shaft extending in the vertical direction and coupled to said motor; and a screw coupling supported by said movable framework and rotatably coupled to said rotational shaft such that reversible rotation of said rotational shaft lifts and lowers said movable framework via said screw coupling.

17. The device according to claim 2, wherein said drive means comprises:

a reversible electric motor supported by said fixed framework, said electric motor having a rotational output shaft extending in the horizontal direction; and a screw jack supported by said fixed framework, said screw jack having a first shaft coupled to said output shaft of said electric motor and a second shaft extending in the vertical direction and driven in the vertical direction, said second shaft being coupled to said movable framework.

* * * * *